US005228624A

United States Patent [19]

Mensink

[11] Patent Number: 5,228,624

[45] Date of Patent: Jul. 20, 1993

[54] SWIRLING STRUCTURE FOR MIXING TWO CONCENTRIC FLUID FLOWS AT NOZZLE OUTLET

[76] Inventor: Daniel L. Mensink, 3578 Gregory La., Lynchburg, Va. 24503

[21] Appl. No.: 844,326

[22] Filed: Mar. 2, 1992

[51] Int. Cl.[5] ..... B05B 7/10

[52] U.S. Cl. ..... 239/406; 239/405

[58] Field of Search ..... 239/403, 405, 406, 423, 239/424, 433, 472–475

[56] References Cited

U.S. PATENT DOCUMENTS

| | | | |
|---|---|---|---|
| 744,220 | 11/1903 | Neu | 239/406 |
| 1,241,135 | 9/1917 | Mastenbrook | 239/405 |
| 1,547,349 | 7/1925 | Reichenbach | 239/405 |
| 2,526,220 | 10/1950 | Goddard | 239/406 |
| 2,878,065 | 3/1959 | Watkins | 239/405 |
| 2,895,685 | 7/1959 | Peeps | 239/405 |
| 3,790,086 | 2/1974 | Masai | 239/406 |
| 4,221,558 | 9/1980 | Santisi | 239/406 |
| 4,546,923 | 10/1985 | Ii | 239/406 |

*Primary Examiner*—Andres Kashnikow
*Assistant Examiner*—Karen B. Merritt
*Attorney, Agent, or Firm*—Harold M. Dixon; William R. Moser; Richard E. Constant

[57] ABSTRACT

A nozzle device for causing two fluids to mix together. In particular, a spray nozzle comprise two hollow, concentric housings, an inner housing and an outer housing. The inner housing has a channel formed therethrough for a first fluid. Its outer surface cooperates with the interior surface of the outer housing to define the second channel for a second fluid. The outer surface of the inner housing and the inner surface of the outer housing each carry a plurality of vanes that interleave but do not touch, each vane of one housing being between two vanes of the other housing. The vanes are curved and the inner surface of the outer housing and the outer surface of the inner housing converge to narrow the second channel. The shape of second channel results in a swirling, accelerating second fluid that will impact the first fluid just past the end of the nozzle where mixing will take place.

15 Claims, 2 Drawing Sheets

SWIRLING STRUCTURE FOR MIXING TWO CONCENTRIC FLUID FLOWS AT NOZZLE OUTLET

The United States Government has rights in this invention pursuant to Contract No. DE-AC09-89SR18035 between the U.S. Department of Energy and Westinghouse Savannah River Company.

BACKGROUND OF THE INVENTION

1. Field of the Invention:

The present invention relates to nozzles. More particularly, the present invention relates to spray nozzles for causing two fluids to mix together.

2. Discussion of Background:

Spray nozzles for mixing fluids are well known. Numerous U.S. patents disclose spray nozzles that mix liquids, liquids and gases, particularly liquids with air and air and combustible gas.

In Ii, U.S. Pat. No. 4,546,923, and Masai, U.S. Pat. No. 3,790,086, nozzles are described for atomizing fluids by passing a liquid through a swirling gas. In Masai, the gas is conically swirled by a series of vanes along the face of the nozzle end as liquid is ejected into the gas flow.

Mastenbrook, in U.S. Pat. No. 1,241,135, discloses a nozzle device for producing a highly combustible mixture of air and gas for introduction into the combustion chamber of a furnace. The apparatus introduces gas or vaporized oil from a central sleeve into a chamber. The central sleeve is surrounded by a series of spiral vanes that in combination introduce swirling air into the chamber.

Another nozzle that provides a mixture for introduction to a combustion chamber is described in Watkins' U.S. Pat. No. 2,878,065. His nozzle is a liquid fuel discharge nozzle that supplies liquid tangentially to the combustion chamber. The single housing nozzle has a conical swirl chamber with a fuel passageway that delivers a liquid fuel into a swirling air current supplied through an annular air passage formed by a grooved housing to direct the air in a swirling motion.

Peeps, in U.S. Pat. No. 2,895,685, and Reichenbach, in U.S. Pat. No. 1,547,349, disclose spray nozzles that are used to mix air with paint or other liquids prior to dispensing the paint. In Peeps, the nozzle divides a stream of air into a plurality of annular jets that are directed to converge radially toward the longitudinal axis of a central spray nozzle. The nozzle disclosed in Reichenbach consists of a tapered inner member and a tapered outer member. The use of ribs on the exterior of the outer member to induce a helical path for the air is disclosed.

Despite existing nozzle designs for mixing fluids, it is believed that there are no nozzles that use interleaved flow vanes and narrowing channels to swirl and accelerate one fluid into another to bring about their mixing and there remains a need for efficient, two fluid mixing in a number of applications.

SUMMARY OF THE INVENTION

According to its major aspects and broadly stated, the present invention is a device for causing two fluids to mix together. In particular, it is a spray nozzle for mixing liquids, liquids with gases, and, in particular, air with slurried particles. Slurried particles or particles carried by a fluid are considered to be a "fluid" for purposes of the present description of the invention. The nozzle is comprised of a hollow inner housing and outer housing. The hollow inner housing has a first channel formed therein for the flow of a first fluid. The inner and outer housings are spaced apart to form a second channel for a second fluid. On the outside surface of the inner channel is a plurality of flow vanes or ribs that extend into the second channel. On the inner surface of the outer housing is a plurality of vanes extending into the second channel. The vanes carried by the two housings are interleaved so that a flow vane from the inner housing extends between two flow vanes of the outer housing.

The vanes are curved and the outer surface of the inner housing and the inner surface of the outer housing converge so that the second channel narrows toward the end of the housings in order to impart a helical or swirling motion to the second fluid and accelerate it as it leaves the nozzle. The vanes direct the second fluid into the first after the fluids exit their respective channels. Mixing occurs on impact.

An important feature of the present invention is the cooperation of the outer surface of the inner housing and the inner surface of the outer housing that define the second channel in directing the second fluid. In particular, the two sets of interleaved, curved vanes and the converging of these two surfaces toward the end of the nozzle cause the second fluid to swirl and accelerate and direct it into the first fluid when the latter emerges from the first channel for effective mixing.

A specific part of this feature is the interleaving of the vanes of the inner and outer housing. These vanes do not touch; however, through interleaving, they control the second fluid and influence its direction without unnecessarily constricting the fluid's flow.

Another specific aspect of this feature is the curving of the vanes of the inner and outer housing. By curving, these vanes impart a tangential component to the motion of the second fluid, a swirl, a helical path that contributes to the effective mixing.

Still another aspect of this feature is the converging of the two annular surfaces to narrow the second channel and accelerate the second fluid as it leaves the nozzle and impacts on the first fluid leaving the first channel. The feature also contributes to the effective mixing of the two fluids.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
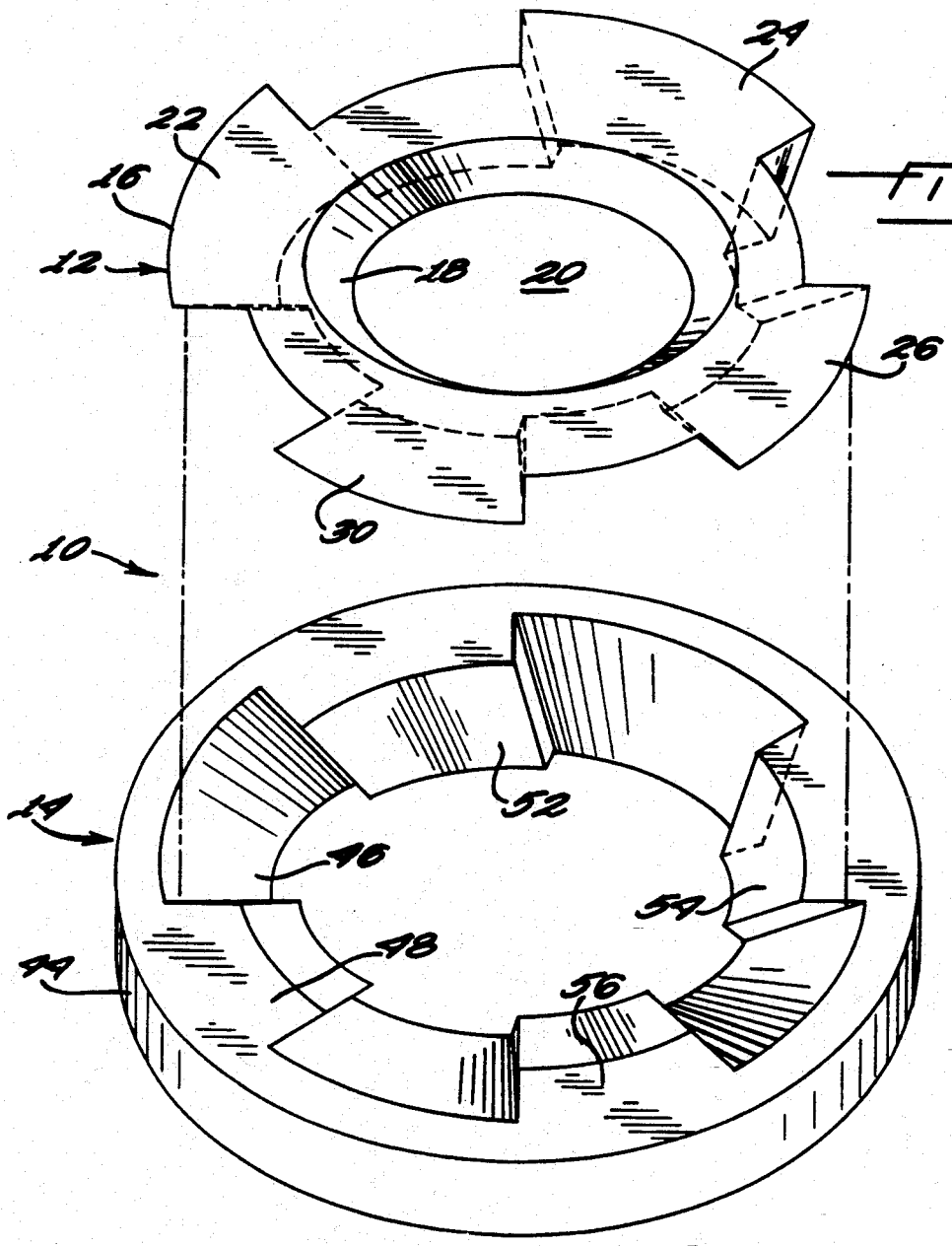
FIG. 1 is an exploded, perspective view of a nozzle device for mixing two fluids according to a preferred embodiment of the present invention.

Referring now to FIG. 1, there is shown an exploded view of a nozzle 10 according to a preferred embodiment of the present invention. Nozzle 10 comprises a hollow inner housing 12 and a hollow outer housing 14. Inner housing 12 is generally cylindrical and has an outer surface 16 and an inner surface 18. Inner surface 18 defines a first channel 20 that allows a fluid, such as a liquid, a gas or slurried particles, to flow through. Inner housing 12 also has a plurality of flow vanes 22, 24, 26, and 30 that are carried by, and are preferably integral to, and extend radially from inner housing 12. Also as shown in FIG. 1, outer housing 14 has an outer surface 44 and an inner surface 46. Inner surface 46 carries a plurality of vanes 48, 52, 54 and 56.

Figure 2:
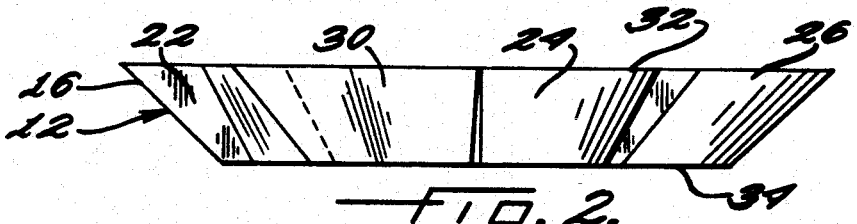
FIG. 2 is a side view of the inner housing of the nozzle according to a preferred embodiment of the present invention.

FIG. 2 shows a side view of inner housing 12, with outer surface 16, along with views of flow vanes 24, 26, and 30. Also, it can be seen that inner housing 12 has a general conical shape, thus it slants inward from a back or top side 32 toward a front or bottom side 34 which is the end of the nozzle since fluid flows from top side 32 to bottom side 34.

Figure 3:
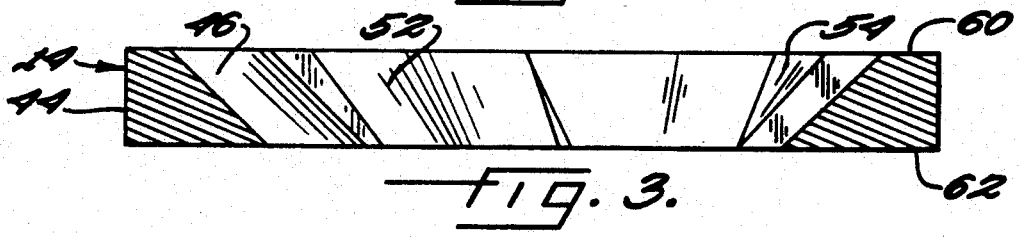
FIG. 3 is a side, cross-sectional view of the outer housing of the nozzle according to a preferred embodiment of the present invention.
Figure 4:
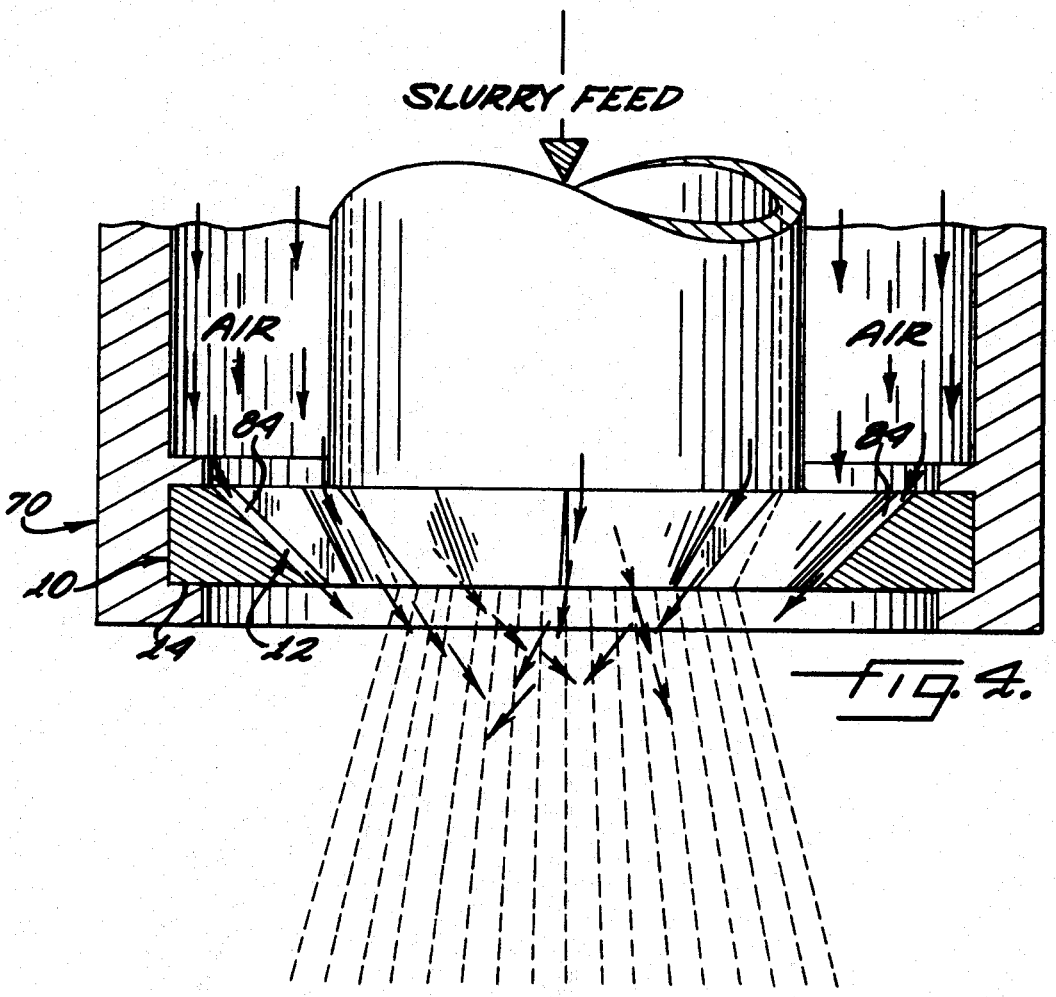
FIG. 4 is a partial, cross-sectional view of the nozzle according to a preferred embodiment of the present invention.

Similarly, in FIG. 3, a side cross-sectional view of outer housing 14 shows inner surface 46 and vanes 52 and 54. From this side cross-sectional view, the general conical shape of the interior of outer housing 14 is shown. Thus, inner surface 46 and vanes 48, 52, 54, and 56 (FIG. 1) slant inward from a back or top side 60 toward a front or bottom side 62. The end or side 62 of the outer housing being substantially coincident with the end or side 34 of the inner housing (FIG. 4). The importance of the conical shape of both inner housing 12 and outer housing 14 will be discussed below.

Referring now to FIG. 4, when inner housing 12 and outer housing 14 are put together to form nozzle 10 and attached to a delivery system 70, they can cause the mixing of two fluids, such as, for example, air and a slurry, as indicated in FIG. 4. Specifically, inner and outer housings 12, 14 are put together so that the vanes of each interleave, with one vane of inner housing 12 between two vanes of outer housing 14 and vice versa.

It should be noted that when the vanes of inner housing 12 and outer housing 14 are interleaved, they do not touch but rather leave a second channel 84 therebetween for the second fluid. The size and shape of the vanes define second channel 84 and dictate the characteristics of second fluid upon emergence from second channel.

When in use, nozzle 10 is connected to supplies of the first and the second fluids. The two fluid supplies are connected so that the first fluid flows through first channel 20 and the second fluid flows through second channel 84.

Figure 5:
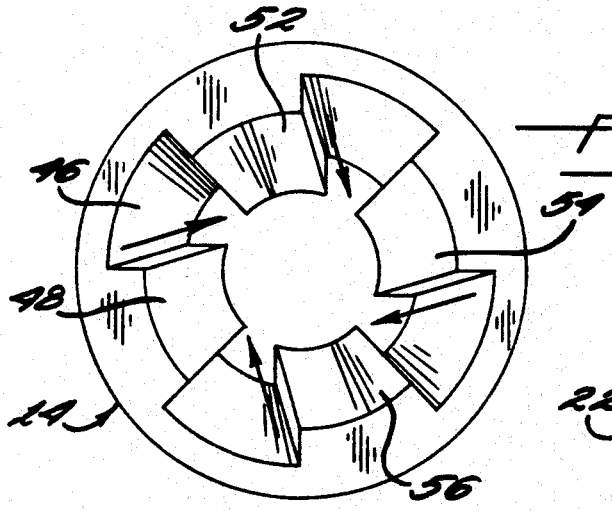
FIG. 5 is a top view of the outer housing of the nozzle according to a preferred embodiment of the present invention.
Figure 6:
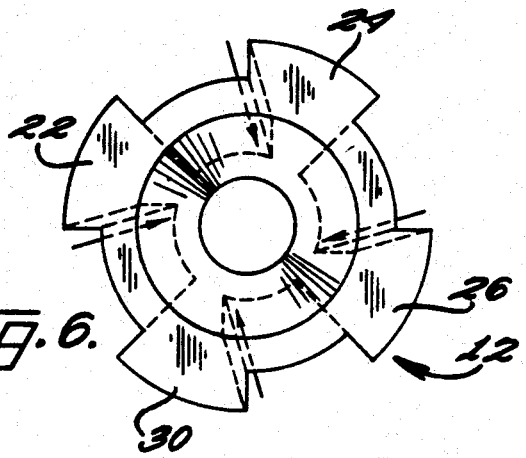
FIG. 6 is a top view of the inner housing of the nozzle according to a preferred embodiment of the present invention.

Referring now to FIG. 5, a top view of outer housing 14, the preferred shape of vanes 48, 52, 54, and 56 can be seen. Likewise, in FIG. 6, a top view of inner housing 12, the preferred shape of flow vanes 22, 24, 26, and 30 can be seen. The conical contour of inner surface 46 of outer housing 14 in cooperation with the conical contour of outer surface 14 of inner housing 10 result in a narrowing of second channel 84 and an acceleration of second fluid as it passes through second channel 84. Also, inner and outer housings 12, 14 cooperate to impart a radial component to the second fluid as it flows through second channel 84. Similarly, the curved sides of vanes 22, 24, 26, and 30 carried on outer surface 16 of inner housing 12 in cooperation with the curved sides of vanes 48, 52, 54, 56 carried on inner surface 46 of outer housing 14 impart a tangential component to the second fluid when it flows through second channel 84 to cause it to swirl through a helical path from to top side of nozzle 10 to the bottom side.

Inner housing 12 is oriented with respect to outer housing 14 so that each vane carried by outer surface 16 of inner housing 12 is between two vanes carried by inner surface 46 of outer housing 14. The second fluid supply sends the second fluid through second channel 84.

Second channel 84 is preferably sized and shaped so that, when the first and second fluid supplies are connected and feeding their respective fluids to first and second channels, respectively, the second fluid swirls and accelerates toward the end of nozzle 10 to ultimately impact and mix with the first fluid just past nozzle 10.

It will be apparent to those skilled in the art that many changes and substitutions can be made to the preferred embodiment herein described without departing from the spirit and scope of the present invention as defined by the appended claims.

What is claimed is:

1. Apparatus for causing the mixing of a first fluid and a second fluid, said apparatus comprising:

a hollow outer housing having an inner surface and an end;

a hollow inner housing spaced apart from and not touching said outer housing and within and generally concentric to said outer housing, said inner housing having an outer surface, an inner surface and an end, said end of said outer housing being substantially coincident with said end of said inner housing, said inner surface of said inner housing defining a first channel through which a first fluid can flow, said outer surface of said inner housing and said inner surface of said outer housing defining therebetween a second channel through which a second fluid can flow;

first means carried by said outer surface of said inner housing for directing the flow of said second fluid in said second channel; and second means carried by said inner surface of said outer housing for directing the flow of said second fluid in said second channel, said first and second directing means being interleaved to direct said second fluid into engagement with said first fluid past said ends of said inner and outer housings where mixing takes place.

2. The apparatus as recited in claim 1, wherein said first directing means further comprises a plurality of first vanes.

3. The apparatus as recited in claim 1, wherein said second directing means further comprises a plurality of second vanes.

4. The apparatus as recited in claim 1, wherein said first directing means further comprises a plurality of first vanes, and said second directing means further comprises a plurality of second vanes.

5. The apparatus as recited in claim 1, wherein said first directing means further comprises a plurality of first vanes, and said second directing means further comprises a plurality of second vanes, said first and said second vanes being interleaved.

6. The apparatus as recited in claim 1, wherein said inner surface of said outer housing and said outer surface of said inner housing converge so that said second channel becomes narrower toward said ends of said first and second housings.

7. The apparatus as recited in claim 1, wherein said first directing means is formed in said outer surface of said inner housing and said second directing means is formed in said inner surface of said outer housing, said first and second directing means formed to direct said second fluid tangentially so that said fluid is swirling upon passing said ends of said first and second housings.

8. The apparatus as recited in claim 1, wherein said first directing means further comprises a plurality of first vanes, and said second directing means further comprises a plurality of second vanes, said first and said second vanes being curved to direct said second fluid in a helical path toward said ends of said first and said second housings.

9. The apparatus as recited in claim 1, wherein said inner surface of said outer housing and said outer surface of said inner housing converge so that said second channel becomes narrower toward said ends of said first and second housings, and said first directing means further comprises a plurality of first vanes, and said second directing means further comprises a plurality of second vanes, said first and said second vanes being curved to direct said second fluid in a helical path toward said ends of said first and said second housings so that said second fluid accelerates and is swirling as said second fluid passes said ends of said first and said second housings.

10. Apparatus for causing the mixing of a first fluid and a second fluid, said apparatus comprising:

a hollow outer housing having an inner surface and an end;

a hollow inner housing spaced apart from and not touching said outer housing and within and generally concentric to said outer housing, said inner housing having an outer surface, an inner surface and an end, said end of said outer housing being substantially coincident with said end of said inner housing, said inner surface of said inner housing defining a first channel through which a first fluid can flow, said outer surface of said inner housing and said inner surface of said outer housing defining a second channel through which a second fluid can flow;

a first plurality of vanes carried by said outer surface of said inner housing for directing the flow of said second fluid in said second channel; and a second plurality of vanes carried by said inner surface of said outer housing for directing the flow of said second fluid in said second channel, said first and second plurality of vanes being arranged so that one vane of said first plurality of vanes is between but not touching each vane of said second plurality of vanes so that said first and said second plurality of vanes cooperate to direct said second fluid into engagement with said first fluid past said ends of said inner and outer housings where mixing takes place.

11. The apparatus as recited in claim 10, wherein said inner surface of said outer housing and said outer surface of said inner housing converge so that said second channel becomes narrower and said second fluid accelerates as it passes through said second channel.

12. The apparatus as recited in claim 10, wherein said first and said second plurality of vanes are curved so that said second fluid is directed in a helical path as it passes through said second channel.

13. The apparatus as recited in claim 10, wherein said first and said second plurality of vanes are curved and said inner surface of said outer housing and said outer surface of said inner housing converge so that said second channel becomes narrower and said second fluid accelerates and swirls in a helical path as it passes through said second channel.

14. Apparatus for causing the mixing of a first fluid and a second fluid, said apparatus comprising:

a hollow outer housing having an inner surface and an end;

a hollow inner housing spaced apart from and not touching said outer housing and within and generally concentric to said outer housing, said inner housing having an outer surface, an inner surface and an end, said end of said outer housing being substantially coincident with said end of said inner housing, said inner surface of said inner housing defining a first channel through which a first fluid can flow, said outer surface of said inner housing and said inner surface of said outer housing defining a second channel through which a second fluid can flow;

a first plurality of vanes carried by said outer surface of said inner housing for directing the flow of said second fluid in said second channel; and a second plurality of vanes carried by said inner surface of said outer housing for directing the flow of said second fluid in said second channel, said first and second plurality of vanes being arranged so that one vane of said first plurality of vanes is between but not touching each vane of said second plurality of vanes so that said first and said second plurality of vanes cooperate to direct said second fluid into engagement with said first fluid past said ends of said inner and outer housings where mixing takes place, and said outer surface of said inner housing and said inner surface of said outer housing being curved and converging so that said second fluid moves in a helical path and accelerates as it moves through said second channel.

15. The apparatus as recited in claim 14, wherein said first plurality of vanes is integral with said inner housing and said second plurality of vanes is integral with said outer housing.

* * * * *